United States Patent [19]

Schlueter

[11] 4,151,726

[45] May 1, 1979

[54] COIL AND CABINET ASSEMBLY FOR AIR HANDLER

[75] Inventor: Valerian F. Schlueter, Norman, Okla.

[73] Assignee: Westinghouse Electric Corp., Pittsburgh, Pa.

[21] Appl. No.: 867,843

[22] Filed: Jan. 9, 1978

[51] Int. Cl.[2] ..... F25D 21/14; F25B 27/00

[52] U.S. Cl. ..... 62/285; 62/286; 62/326

[58] Field of Search ..... 62/285, 286, 291, 326; 98/33; 165/137, 76

[56] References Cited

U.S. PATENT DOCUMENTS

| | | | |
|---|---|---|---|
| 3,089,315 | 5/1963 | Brandt | 62/326 |
| 3,299,660 | 1/1967 | Sullivan | 62/285 |
| 3,596,475 | 8/1971 | Berger | 62/285 |
| 3,678,993 | 7/1972 | Pierce | 62/326 |
| 4,088,466 | 5/1978 | Humphrey et al. | 62/286 |

*Primary Examiner*—Lloyd L. King
*Attorney, Agent, or Firm*—E. C. Arenz

[57] ABSTRACT

A coil and cabinet assembly for an air handler is provided in which the refrigerant coil is disposed diagonally within a coil section of the cabinet, the coil having a drain trough for collecting condensate when the air handler is in its upright vertical disposition, a second condensate drain trough adapted for installation in the cabinet at the opposite edge of the coil when the cabinet is to be installed in an inverted upright disposition, both drain troughs having drain outlets projecting from the front face ends of the troughs and extending at their respective locations through lower and upper detachable cross members extending between the opposite sides of the cabinet. The coil also has connected thereto refrigerant liquid and suction gas line fittings which project through one of the detachable cross members, the front face of the cabinet including, along with the detachable cross members, detachable access panels covering the area between the cross members, these access panels being devoid of openings or knockouts to accommodate the refrigerant line connections and drain outlet connections. Thus the projections of the drain outlets and refrigerant line fittings cooperate in holding the coil in its installed position in the cabinet and avoiding the usual requirement of providing panels with patch plates and knockouts.

3 Claims, 10 Drawing Figures

COIL AND CABINET ASSEMBLY FOR AIR HANDLER

BACKGROUND OF THE INVENTION

1. Field of the Invention

The invention pertains to air conditioning unit constructions and in particular to constructions involving refrigerant coil dispositions and cabinet constructions to accommodate different positionings of the unit.

2. Description of the Prior Art

The general type of air conditioning unit with which this invention is mainly concerned is sometimes called an air handler in the art, and basically includes a cabinet having a refrigerant evaporator coil in what is called the coil section, and a blower in the adjacent blower section. Such units are ordinarily used in what is called a split system where the refrigerant compressor and condenser are housed in a separate remote unit.

Depending upon the particular building construction in which the unit is to be installed, it is desirable that a given unit be adapted for installation in either a vertical disposition or a horizontal disposition. Further, in the vertical disposition the application may be for either up-flow in which the air passes upwardly through the unit, or in down-flow in which the air passes down through the unit. It is also desirable in the vertical dispositions that the air inlet location be available not only at the end of the unit, but alternatively at least from one side of the coil section. Thus in a vertical disposition, it is necessary that condensate be able to be connected at whichever edge of the coil is lower, and in the horizontal disposition, provision should be made to not only collect condensate at the lower edge of the coil, but also to catch condensate which may drip from the fins and pass it to the drain trough at the lower edge of the coil.

Different manufacturers typically have different approaches to solving the problem of providing for the various dispositions of the cabinet, as well as collecting the condensate regardless of disposition and regardless of the direction of entering air flow. In some cases, the coil is arranged to be removed and repositioned, and sometimes with a repositioning of whatever condensate drain trough is used. One disadvantage of such arrangement is that typically the access panels which are removed for accomplishing the rearrangement must be provided with knockouts to accommodate drain outlets and refrigerant line connections in the various locations where they fall in accordance with coil positioning. Additionally, patch plates may be required to be used and sometimes the knockout openings, particularly if slotted, are not especially easy to seal. One example of prior art in which a number of knockouts are provided may be found in U.S. patent application Ser. No. 829,701, filed Sept. 1, 1977.

Another disadvantage of the multiple knockout approach is that the panels containing the knockouts are weakened as contrasted with a panel of the same gauge without knockouts. Thus additional stiffening members may be required where the knockout panels are lacking in the requisite rigidity and strength.

The reason for providing some flexibility in disposition of the cabinet and the coils is of course to avoid requiring a manufacturer of units to make a different model to accommodate each particular installation. The problem of making different models is compounded by the significant number of different capacity air handler units required for different installations.

The problem of cabinet and coil dispositions has been recognized in the air conditioning field and the following examples are representative of U.S. patents dealing with the subject: U.S. Pat. Nos. 3,089,315; 3,299,660; 3,596,475; and 3,678,993.

The basic approach of my invention is to provide a cabinet and coil assembly in which the coil remains in its disposition irrespective of whether the cabinet is to be installed in an upright, inverted, or horizontal disposition. To accommodate the inverted disposition, an auxiliary drain trough is added as an accessory without removing the coil. For the horizontal disposition, a drip pan is added to underlie the area in a horizontal plane below the downstream face of the coil. The invention also provides a cabinet which is constructed to cooperate with the projecting elements such as drain outlets and refrigerant line connections to aid in holding the coil in place in the cabinet, but with these projections occurring in parts of the front wall of the cabinet which are more of a structural character than of an access character so that the access panels may be devoid of knockouts.

SUMMARY OF THE INVENTION

In accordance with the invention, the cabinet and coil assembly arrangement is one in which the coil is substantially fixed in a diagonal disposition in the coil section of the cabinet, with a first drain trough along one edge of the coil and having a drain outlet projecting out through a first detachable cross member at the lower end of the coil section front face, the refrigerant liquid and gas line connections for the coil projecting out through a second detachable cross member at about the level of the other edge of the coil, the second cross member also accommodating the projection of a drain outlet of a second drain trough for said other edge of the coil when the second drain trough is used for an inverted disposition of the cabinet, the area between the first and second cross members on the one face of the cabinet being covered by an access panel which is thus devoid of openings to accommodate refrigerant line connections and drain outlets.

DRAWING DESCRIPTION

FIG. 1 is an isometric view of an air conditioning unit according to the invention;

FIGS. 2 through 4 inclusive are somewhat schematic front-face views of a unit with access panels removed, showing the three basic dispositions of the cabinet with arrows indicating directions of air flow;

DESCRIPTION OF THE PREFERRED EMBODIMENT

Figure 1:
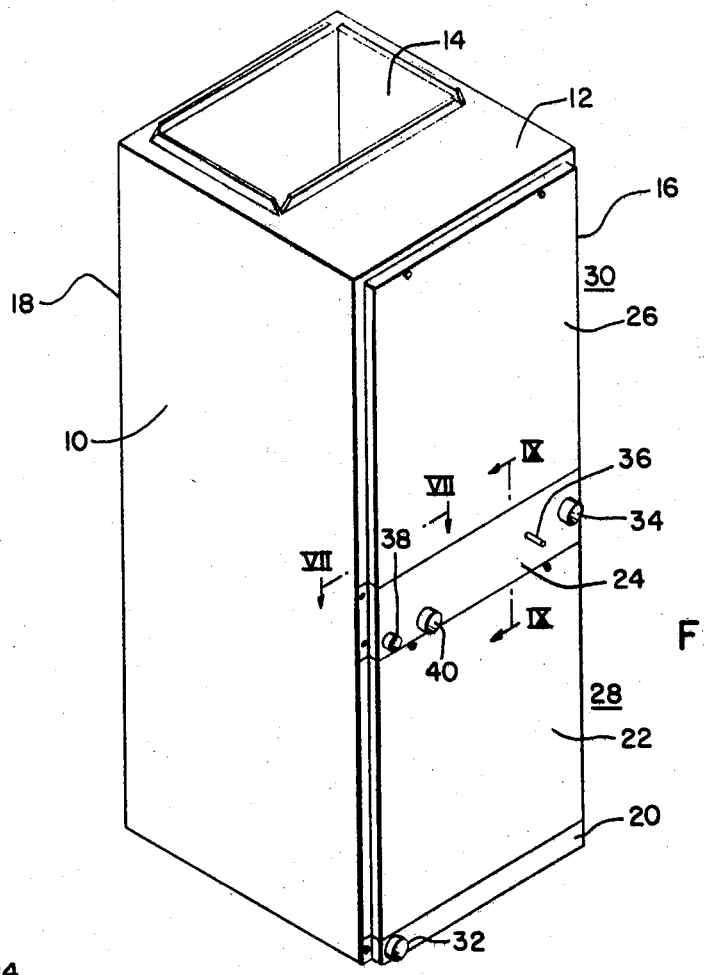

Referring to FIG. 1, the shell of the cabinet includes left wall 10, top wall 12 with air outlet 14, right wall 16, rear wall 18 and front wall which includes, in ascending order, a first, lower cross member 20, a coil section access panel 22, a second, upper cross member 24, and a blower section access panel 26. The interior of the cabinet is divided into the lower coil section 28 behind the access panel 22, and the upper blower section 30 behind the panel 26. The upper part of the blower section is also used to house controls as well as electrical resistance heating elements if they are used.

In FIG. 1, a number of elements are shown as projecting through the cross members 20 and 24 on the front face. These projecting parts are the drain outlet 32 for the drain trough at the lower edge of the coil when the cabinet is in the upright disposition of FIG. 2, the drain outlet 34 and overflow tube 36 of the second drain trough which is at the lower edge of the coil when the unit is in the inverted position of FIG. 3, and the refrigerant liquid and gas line connectors 38 and 40, respectively, also projecting through the second cross member 24.

Figure 6:
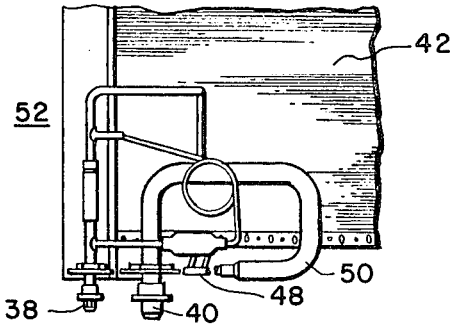
FIG. 6 is a fragmentary top view of a corner of the coil of FIG. 5.
Figure 5:
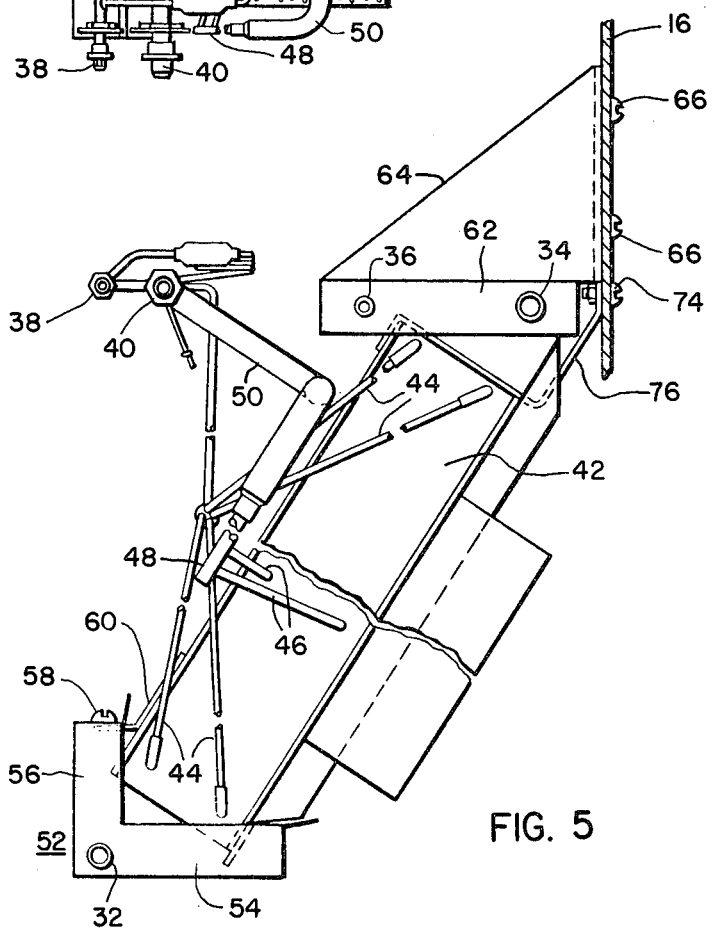
FIG. 5 is an end view of a coil assembly with drain troughs installed at both ends of the coil, and with the end bends omitted at the end of the coil.

Referring to FIGS. 5 and 6, the general arrangement of the refrigerant coil and drain pans may be seen with the parts out of the cabinet. The coil 42 is of conventional fin and tube construction with refrigerant being fed to and received from the coil at the front end edge of the coil. To this end, the liquid refrigerant which is passed to the liquid line connector 38 is passed after expansion through the small diameter lines 44 to the various circuits of the coil. Suction gas is returned from the coil through the lines 46 to the suction gas manifold 48 and through the insulated line 50 to the suction gas connector 40 from whence the refrigerant is returned to the compressor through a line exterior to the cabinet. These refrigerant lines are of rigid tubing and as such, the captured relation of the refrigerant connectors in the second or upper cross member 24 aids in holding the coil assembly in place when it is installed in the cabinet.

In FIG. 5, the standard L-shaped drain trough 52 which is present with the coil in any disposition of the cabinet is shown in its attached relation to the one edge of the coil. The coil seats in the open faces of the two legs 54 and 56 of the drain pan, the condensate from the coil flowing into the leg 54 when the air handler is in its upright disposition, and the condensate flowing into the leg 56 when the cabinet is in its horizontal disposition. In either case, the collected condensate drains through the pipe 32 at the corner of the drain trough. The trough 52 is attached to the frame of the coil at both the front and the rear by a fastener 58 extending through a bracket 60 attached to the coil frame.

The standard air handler as shipped from the manufacturer has only the drain trough 52 installed with the coil in the cabinet. This is because the air handler is most frequently installed in the upright disposition as contrasted to an inverted disposition. However, an accessory drain trough 62 (FIG. 5) is available if the air handler is to be installed in an inverted position. The drain trough 62 has the general form of a shallow pan with its lower face as seen in FIG. 5 being open and receiving a part of the one end edge of the coil 42. The drain outlet 34 and overflow tube 36 project forwardly from the front face end of the drain trough. The drain trough 62 is provided with a pair of triangularly shaped brackets 64 provided with flanges to abut the side wall 16 as seen in FIG. 4 to permit fastening of the brackets to the side wall 16 with the fasteners 66.

Figure 2:
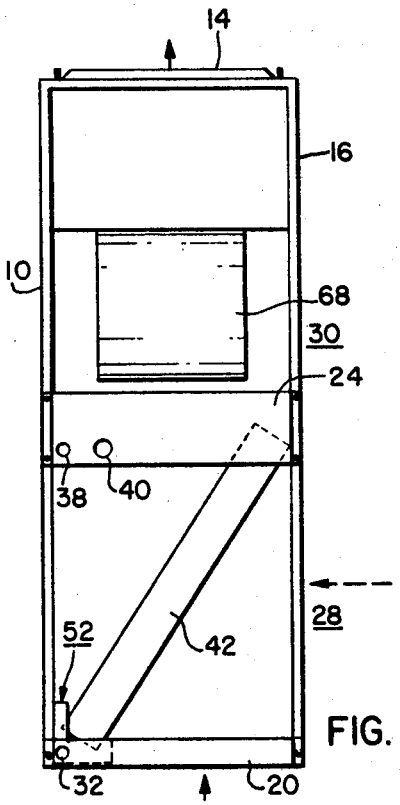
Figure 3:
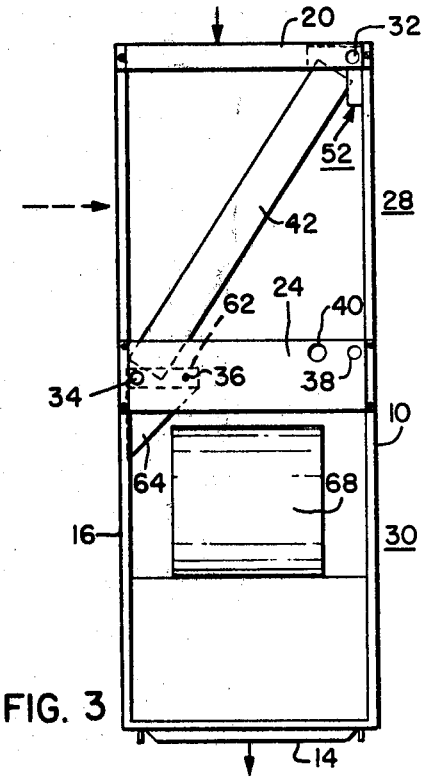
Figure 4:
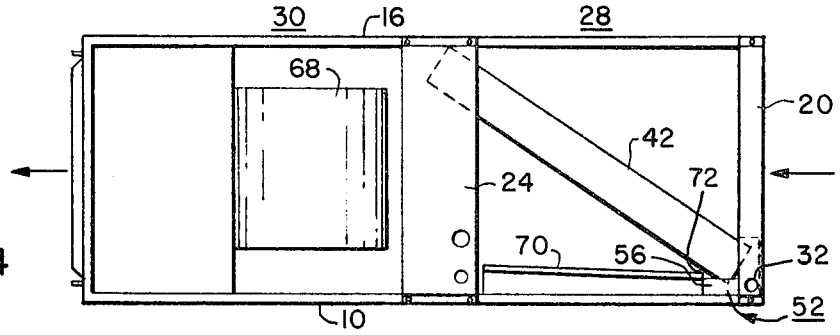

Referring now to FIGS. 2–4, the three basic dispositions of the air handler unit are shown. In FIG. 1, the air handler is installed in a vertical, upright disposition with the inlet air being admitted either through the bottom or alternatively through a knockout in the right side wall 16 as indicated by the dash line arrow. The air flow is induced into the inlet by the blower 68 which takes the form of a centrifugal fan drawing the air in through whichever inlet is used, through the coil 42, and discharges it out of the outlet 14 in the wall 12. It will be noted in FIG. 2 that only the L-shaped drain pan 52 is provided.

In FIG. 3 the air handler unit is installed in its inverted, upright dispositoin with the inlet air being drawn into the unit either through the top face or, as indicated by the dash line arrow, through the alternate knockout inlet section in the wall 16. For the inverted, vertical disposition of the unit in FIG. 3, the auxiliary or second drain trough 62 has been added. However the first drain trough 52 remains in place since this is the standard construction and the drain trough at that end of the coil assists in positioning and holding the coil in place.

In FIG. 4 the unit is installed in a horizontal disposition, and a horizontal drip pan 70 is installed to catch drops of condensate which may drop off the fins of the coil 42. This drip pan is of relatively large area so as to underlie most of the area of the downstream face of the coil 42 and it extends in slightly inclined relationship to the side wall 10 of the unit and has its lower edge 72 lapping the edge of the one leg 56 of the L-shaped drain trough 52 so that any condensate which drops on to the drip pan will flow into the drain trough 52. As in the case of the vertical, upright disposition of the unit in FIG. 2, the auxiliary drain trough 62 is unnecessary in the horizontal disposition and is omitted. In this case, the upper edge of the coil is secured to the side wall 16 (FIG. 5) by fasteners 74 which pass through the side wall 16 and into bracket means 76 attached to the one edge of the coil.

Figure 7:
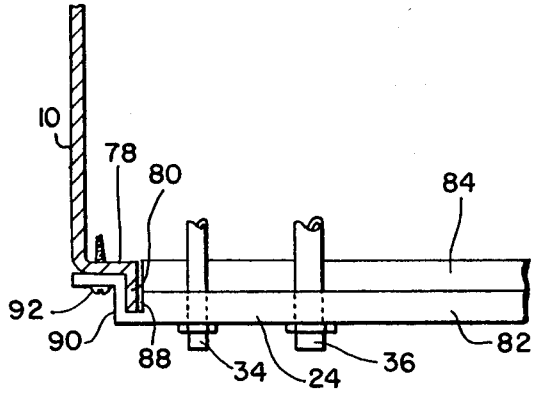
FIG. 7 is a fragmentary view partly in section corresponding to a view taken along the line VII—VII of FIG. 1 and showing the interfitting relationship between the side of the cabinet and one end of the upper detachable cross member.
Figure 8:
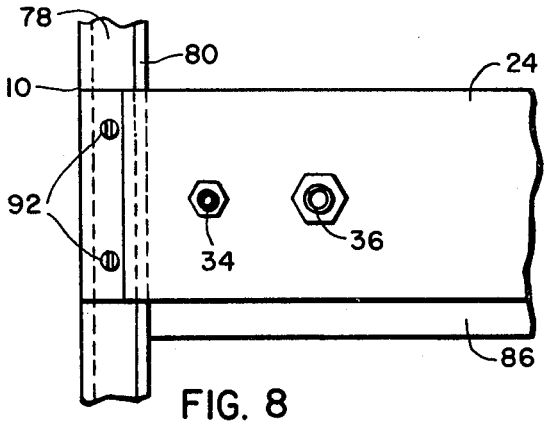
FIG. 8 is a fragmentary front face view of the parts of FIG. 7.

The general structure and interfitting relationship of the cross members and various panels on the front face of the unit are illustrated in FIGS. 7–10. Referring to FIGS. 7 and 8, the side wall 10 includes an inwardly-directed flange 78 and a forwardly-directed flange 80. The forward edge details of the opposite side wall 16, not shown, is a mirror image. The shape of the second cross member 24 is generally that of a channel with the upper leg 82 (FIG. 9) being of a lesser dimension than the corresponding dimension of the lower leg 84 of the channel, which also includes a flange 86 along its edge. Both of the ends of the cross member 24 are similar in construction and include an open portion 88 to receive the forwardly directed flange 80 of the side wall, with the extreme end of the cross member being of the angle shape 90 as shown to permit seating against the flange 78 of the side wall and to be fastened thereto by fasteners 92, as shown in FIGS. 7 and 8.

Figure 9:
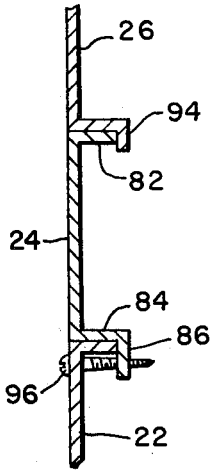
FIG. 9 is a vertical sectional view corresponding to one taken along the line IX—IX of FIG. 1 and illustrating the joint arrangement between the access panel and the upper cross member.
Figure 10:
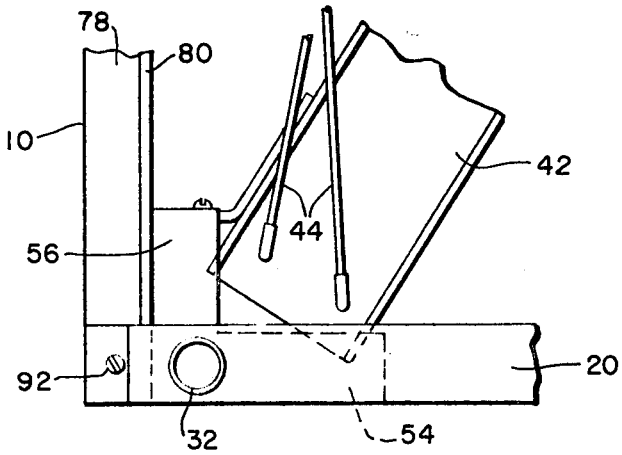
FIG. 10 is a fragmentary front face view of the lower left corner of the unit in FIG. 1.

Referring now to FIG. 9, with the described arrangement, and with the cross member 24 fixed to the opposite side walls by the fasteners 92, the blower access panel 26 is secured in position by hooking its lower angle edge 94 behind the upper flange 82 of the cross member and then swinging the top part of the blower access panel into position to be fastened along its top edge in the same fashion that the coil section panel 22 is fastened at its top edge by the fasteners 96. The lower edge of the coil access panel 22 has the same configuration as the lower edge of the blower access panel and cooperates with the lower cross member 20 in the same way for fastening. Also, the opposite ends of the lower cross member 20 have the same configuration in section as the opposite ends of the upper cross member and is fastened at its opposite ends by the fasteners 92 to the forward edges of the side walls of the cabinet.

With the foregoing in mind, the following is offered as a summary of how the cabinet and coil are assembled and disassembled to effect changes in accordance with the intended final installation of the unit. In assembling a standard unit at the manufacturer's plant, before the cross members 20 and 24, and access panels 22 and 26 are assembled to the cabinet, a coil assembly as shown in FIG. 5 with the drain trough 52 attached to the coil (but with the second drain trough 62 omitted) is placed in the coil section in the diagonal disposition shown in the various Figures. Both the lower cross member 20 and upper cross member 24 are then attached to the opposite side walls 10 and 16 by the fasteners 92, and with the drain outlet 32 projecting through the registering opening in the lower cross member 20 and with the refrigerant connecting fittings 34 and 36 projecting through corresponding openings in the upper cross member 24. Since the auxiliary drain trough 62 is not installed, the projecting drain outlet and overflow tube 34 and 36, respectively, are absent. The coil access panels 22 and 26 are then attached to the cabinet in the manner previously described. This is the way the standard unit is shipped from the manufacturer to the distributor or customer as the case may be.

If the standard unit is to be converted to an inverted, vertical disposition, the blower access panel 26 is removed and the cross member 24 is loosened sufficiently so that the second drain pan assembly 62 (FIG. 5) with its securing bracket 64 can be installed on the top edge of the coil with the brackets then being secured to the side wall 16 as previously described. The second cross member 24 is then resecured with the drain outlet 34 and overflow tube 36 projecting through openings made in this cross member by removing knockouts provided in the cross member as manufactured. The blower access panel is then reinstalled and the unit may then be disposed in its inverted position.

If the standard unit is to be installed in a horizontal disposition, the coil section access panel 22 is removed and the drip pan 70 is installed as shown in FIG. 4 with its lower edge overlapping the one edge of the drain trough 52 and with its opposite end supported from the side wall 10 by a flange.

With the cabinet and coil arrangement as described, a standard unit can be relatively easily changed to accommodate an inverted or a horizontal disposition with the use of two simple accessory assemblies, that is, the second drain trough assembly and the drip pan assembly, and the conversion can be relatively simply effected. The channel-shaped cross members impart strength and rigidity to the cabinet without relying upon the access panels for the rigidity. Thus, the access panels can be made of lighter gauge since their support function is a minor factor. The relatively stiff refrigerant suction line which is captured by the upper cross member and the lower drain pan outlet captured in the lower cross member serve to hold the coil in place so that it need be fastened only to the right side wall 16 by the two fasteners 74 into the brackets 76. Also, since there are no knockouts in the access panels, there is no need to use patch plates for the pipe exits and the sealing problems typically experienced with knockouts are avoided.

I claim:

1. A cabinet and coil assembly for an air handler unit adapted for installation in either an upright vertical disposition, an inverter upright disposition, or a horizontal disposition, comprising:

a cabinet, which with respect to all the locational relationships recited hereinafter is viewed as being in its vertical upright disposition, said cabinet including front, rear, side, and top and bottom walls, the interior of the cabinet being divided into a lower coil section, an intermediate blower section, and an upper control section, the cabinet having blower means in said blower section for creating air flow through said cabinet in a bottom to top direction, the cabinet also having a fin and tube refrigerant coil disposed diagonally in said coil section with the coil lower edge in one bottom corner at one side of the cabinet, the cabinet being adapted to receive return air through inlet opening means in said bottom wall and alternatively through inlet opening means in the other side wall of the coil section, the coil having connected thereto refrigerant liquid and suction gas line connectors;

a first condensate drain trough fixed to the coil and encompassing the lower edge of said coil and including a condensate drain outlet projecting from the end of said trough at the front face of the cabinet;

the front wall of said cabinet including detachable and separate access panels for covering the front face of both said coil section and said blower section, the front wall of said cabinet further including a first cross member extending between the right and left side walls and detachably fastened thereto at the lower end of said coil section, said cross member including an opening therein registering with and receiving said drain outlet of said first drain trough, said front wall further including a second cross member at the level separating said coil and blower sections and extending between the right and left side walls and being detachably fastened thereto;

a second condensate drain trough adapted for installation in said cabinet when said cabinet is to be installed in said inverted upright disposition, said trough being located at the edge of said coil opposite said first trough and having a drain outlet projecting from the front face end of the trough;

said second cross member including means for defining an opening therein adapted to register with and receive said drain outlet of said second trough, and further including openings to receive said refrigerant line connectors; and means for fastening said access panels to said cabinet front face to substantially close the front face, said access panels being devoid of openings to accommodate refrigerant line connections and drain outlet connections.

2. An assembly according to claim 1 including a drip pan adapted for installation in said cabinet when said cabinet is to be installed in said horizontal disposition, said drip pan being of relatively large area and extending along in slightly inclined relationship to said one side wall of said coil section and having its lower edge lapping said first drain trough to feed condensate thereto when said air handler is in said horizontal disposition.

3. An assembly according to claim 1 including fastener means for connecting the top edge portion of said coil to said other side wall, said fastener means cooperating, along with said drain outlets and refrigerant line connectors in captured relation in said openings in said cross members, to hold said coil in place in said cabinet.

* * * * *